US005111245A

United States Patent [19]

DeCecca et al.

[11] Patent Number: 5,111,245

[45] Date of Patent: May 5, 1992

[54] APPARATUS FOR POSITIONING A DEVELOPMENT UNIT WITH RESPECT TO AN IMAGE MEMBER

[75] Inventors: Michael L. DeCecca, Fairport; Arthur S. Kroll; Arthur E. Dunn, both of Rochester, all of N.Y.

[73] Assignee: Eastman Kodak Company, Rochester, N.Y.

[21] Appl. No.: 621,686

[22] Filed: Dec. 3, 1990

[51] Int. Cl.[5] ..... G03G 15/01

[52] U.S. Cl. ..... 355/245; 355/326

[58] Field of Search ..... 355/245, 326-328, 355/211; 118/645; 346/157

[56] References Cited

U.S. PATENT DOCUMENTS

| | | | |
|---|---|---|---|
| 4,622,916 | 11/1986 | Tanaka et al. | 118/688 |
| 4,703,334 | 10/1987 | Mochimaru et al. | 346/160 |
| 4,728,981 | 3/1988 | Koek et al. | 355/1 |
| 4,797,704 | 1/1989 | Hill et al. | 355/260 |
| 4,801,966 | 1/1989 | Ikeda | 355/245 |
| 4,884,109 | 11/1989 | Hill et al. | 355/260 |
| 4,891,672 | 1/1990 | Takagi | 355/245 |
| 4,922,302 | 5/1990 | Hill et al. | 355/251 |
| 4,926,198 | 5/1990 | Barton et al. | 346/155 |
| 4,928,119 | 5/1990 | Walker et al. | 346/108 |
| 4,928,146 | 5/1990 | Yamada | 355/253 |

FOREIGN PATENT DOCUMENTS

| | | | |
|---|---|---|---|
| 59-91460 | 5/1984 | Japan | 355/245 |
| 1-266566 | 10/1989 | Japan | 355/245 |

*Primary Examiner*—Joan H. Pendegrass
*Attorney, Agent, or Firm*—Leonard W. Treash, Jr.

[57] ABSTRACT

An applicator for a development unit is precisely positioned with respect to an image member, such as a photoconductive drum. A pair of pins are fixed with respect to the image member and fit in a pair of holes that are fixed with respect to the applicator. A roller on each of opposite ends of the applicator engages a surface of the image member to properly space the applicator and image member, while the pins and holes control relative lateral and rotational movement.

17 Claims, 9 Drawing Sheets

APPARATUS FOR POSITIONING A DEVELOPMENT UNIT WITH RESPECT TO AN IMAGE MEMBER

TECHNICAL FIELD

This invention relates to apparatus for controlling the relative position of a development unit with respect to an image member, for example, a photoconductive drum.

BACKGROUND ART

A number of references show developing stations which are movable into position with respect to an image member as part of the operation of the machine. For example, U.S. Pat. No. 4,928,146 shows apparatus in which four linearly arranged development stations are sequentially moved to a single development position to apply different color toner to four consecutive electrostatic images. U.S. Pat. No. 4,622,916 shows four toner stations on a rotary carriage which rotates the stations through a single development position to also apply different color toners to four consecutive images. U.S. Pat. No. 4,801,966 is typical of a large number of references showing toning stations that are movable in and out of their own unique developer position to apply the correct color toner to the image being toned. U.S. Pat. No. 4,891,672 shows system in which one of a group of color stations is moved into a single toning position for a series of reproductions and then is replaced on demand from a storage position by another toning station of different color for another series of reproductions.

In most of these apparatus, a drum photoconductor is permanently fixed in the apparatus as is the supporting structure for each development unit. With such structure, critical positioning of each development unit with respect to the photoconductive drum can be managed by precise manufacturing and assembly of those parts and their supporting structure. It would be desirable to remove the need for such precision.

U.S. Pat. Nos. 4,922,302, issued to Hill et al on May 1, 1990; 4,884,109 issued to Hill et al on Nov. 28, 1989 and 4,797,704 issued to Hill et al on Jan. 10, 1989; show a development station having an applicator with a rotating magnetic core and a stationary nonmagnetic sleeve around which a developer mixture is moved by rotation of the core to pass the developer through a development position. The applicator is fed by a rotating paddle positioned below the applicator which both mixes developer and supplies it to the applicator. This particular structure requires that the applicator not be in contact with the image member carrying an electrostatic image to be developed, but that it be precisely spaced from it.

U.S. Pat. No. 4,801,966 (cited above) shows a developer applicator which is spaced from a photoconductive drum by a pair of rollers which engage the drum. This approach will provide accurate spacing only if other aspects of the relative position of the applicator and drum are precisely controlled.

DISCLOSURE OF THE INVENTION

It is an object of the invention to provide an apparatus for precisely positioning an applicator of a development unit or a similar device with respect to a surface of an image member having an axis of rotation.

This and other objects are accomplished by a positioning structure which is best explained with respect to three orthogonal axes, a z axis generally parallel to the axis of rotation of the image member, an x axis generally parallel to a line between the development position and the axis of rotation of the image member, and a y axis orthogonal to the other two axes. The object is accomplished by apparatus which positions the applicator with respect to the image member as to all three axes using structure fixed with respect to one component, but movable relative to the other component in the positioning process.

According to a preferred embodiment, the positioning apparatus includes a pair of pins running generally parallel to the x axis and fixed with respect to one of the components, for example, the image member, meahs defining a pair of holes for receiving the pins which holes are fixed with respect to the other component, for example, the applicator. Means associated with one of the image member and applicator engages structure associated with the other of the image member and applicator for controlling the relative position of the applicator with respect to the image member in a direction parallel to the x axis.

One of the holes restricts its pin from linear movement parallel to either the y or z axes, while the other hole restricts movement of its pin only parallel to the y axis. This structure precisely positions the components linearly with respect to the y and z axes without overconstraint and risk of jamming in operation.

According to a preferred embodiment the means controlling the relative position of the components parallel to the x axis is a pair of rollers fixed with respect to the applicator and directly engaging the image member to precisely separate the applicator and the image member.

According to a further preferred embodiment, one of the holes is defined by side walls which have sufficient depth to restrict the rotation of its pin around the z axis while the other hole does not have such depth and its pin is free to rotate about the z axis with respect to its hole. This feature controls rotational orientation of the applicator with respect to the image member around the z axis without over-constraining the system.

One of the advantages of this structure is that it is sufficiently precise in positioning a development unit applicator with respect to an image member that precision is not necessary in the mounting of either the image member or the development unit with respect to other portions of the apparatus. For example, this permits the image member to be a photoconductive drum which is cartridge loadable in the apparatus without loss of precise positioning.

In a preferred embodiment, the two pins are oriented in the cartridge accurately with respect to the photoconductive drum and the other portions of the positioning mechanism are precisely formed parts of the development unit applicator. The applicator can be movable in the apparatus without losing preciseness when in its operative position.

Although the use of rollers to space an applicator from an image member is known (see, for example, U.S. Pat. No. 4,801,966 mentioned above), rollers alone will not provide accurate spacing. For example, if the applicator is skewed about either the x or z axes compared to the drum, the spacing will vary across the image member despite preciseness in the size and mounting of the rollers. This invention provides the preciseness necessary entirely with positioning means that mate with each other during operation of the machine.

BRIEF DESCRIPTION OF THE DRAWINGS

In the detailed description of the preferred embodiment of the invention presented below, reference is made to the accompanying drawings, in which.

BEST MODE OF CARRYING OUT THE INVENTION

Figure 1:
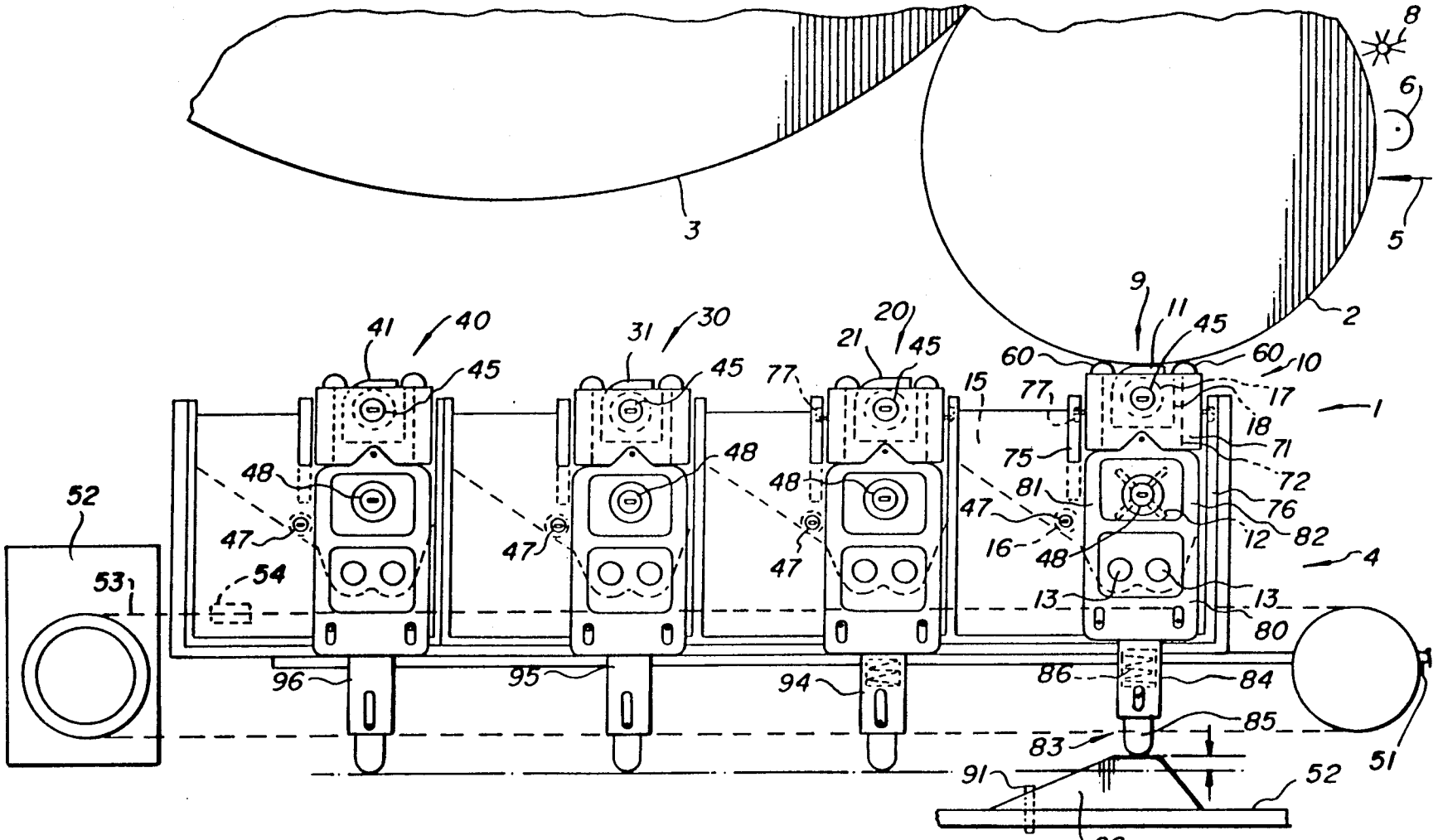
FIG. 1 is a front schematic of a portion of a color printer with many parts eliminated for clarity of illustration.

According to FIG. 1 an electrophotographic color printer 1 includes a photoconductive drum 2 mounted for rotation past a series of stations to create multicolor toner images on a transfer roller 3 or a receiving sheet carried by transfer roller 3, according to a process well-known in the art. More specifically, drum 2 is uniformly charged at a charging station 6, imagewise exposed at an exposure station, for example, a laser exposure station 5 to create a series of electrostatic images. The electrostatic images are developed by developing device 4 which applies a different color toner to each of the series of images to form a series of different color toner images. The series of toner images are then transferred in registration to a surface associated with transfer roller 3 to create a multicolor toner image. The surface associated with roller 3 can either be the surface of transfer roller 3 or the outside surface of a receiving sheet secured to the surface of roller 3. If the multicolor image is formed directly on the surface of transfer roller 3, it is best utilized by being transferred to a receiving sheet at a position remote from drum 2 by a means not shown. If the multicolor image is formed on the surface of a receiving sheet carried by roller 3, that sheet is separated from roller 3, also at a position remote from drum 2, also by a means not shown.

Photoconductive drum 2 is made quite small, its periphery being substantially smaller than a single image. A small photoconductive drum allows it to be easily replaced, for example, replaced as part of a process cartridge which can also include charging station 6 and a cleaning station 8. It also contributes to a reduction of the size and cost of the printer 1. Unfortunately, smallness in the photoconductive drum makes application of different color toners to consecutive electrostatic images difficult to accomplish geometrically. Similar to the prior art cited above, printer 1 solves this problem by moving a series of four development units 10, 20, 30 and 40 through a development position 9 allowing each of the electrostatic images to be toned by a different developing unit but using only a single developing position 9 associated with the drum 2.

According to FIG. 1 the development units 10, 20, 30, and 40 are all fixed in a laterally moveable carriage 50. Carriage 50 is supported on guide rails 51 for linear movement in a horizontal direction below drum 2. Carriage 50 is driven by a motor 52 through a metal drive tape 53 fixed to carriage 50 at 54.

In FIG. 1, developing unit 10 is shown aligned with development position 9. Preferably, carriage 50 has a start position to the left of the position shown in FIG. 1 and moves to the position shown in FIG. I to develop the first electrostatic image of a series. When that image is toned, the carriage again is moved to align developing unit 20 for toning the second electrostatic image. Units 30 and 40 are similarly aligned with position 9 to tone the third and fourth electrostatic images. The carriage 50 is then returned to its start position.

Developing unit 10 includes an applicator 11, a mixing device, for example, paddle 12 and augers 13. The mixing device is located in a development chamber 14 which includes a mixture of hard magnetic carrier particles and insulating toner particles. A supply of toner is contained in a toner chamber 15. Toner is fed from the toner chamber 15 to the development chamber 14 by a toner feed roller 16.

Construction and operation of each unit is essentially the same as the unit described in U.S. Pat. No. 4,797,704, referred to above, the disclosure of which patent is incorporated by reference herein. In operation, rotation of paddle 12 and augers 13 cause both the mixing of developer in chamber 14 and a raising of the level of that developer making it accessible to the magnetic field of applicator 11. Applicator 11, as described more thoroughly in the above patent, includes a rotatable magnetic core 17 and a stationary sleeve 18. Hard magnetic carrier particles move around the sleeve 18 in response to rotation of the core bringing the developer through developing position 9. The developer is moved by the rotating core at essentially the same speed as the electrostatic image is moving on rotating drum 2 providing high quality development of the electrostatic image. Development units 20, 30 and 40 are of essentially the same construction, although note that the toner chamber 45 of developing unit 40 is larger than the other toner chambers. The development unit 40 contains black toner which is used more often than the color toners in units 10, 20, and 30. Units 10, 20 and 30 can have cyan, magenta and yellow toners for doing full color reproductions or could hold highlight color toners, for example, red, blue and yellow.

The development system utilized by development units 10, 20, 30 and 40 requires a small precise spacing between the sleeve 18 of applicator 11 and the drum 2. This is accomplished, according to FIG. 1, by four rollers 60, one on each side of the applicator on each end of unit 10. Rollers 60 are precisely positioned and sized so that, when urged against drum 2 as shown in FIG. 1 with unit 10, they precisely space applicator 11 with respect to drum 2.

In the prior art cited above, each developing unit is aligned with a developing position. Either after it is aligned or as it is aligned, the unit is moved with respect to the other units toward the development position to engage a photoconductive drum. This latter movement requires that each of the developing units be movable with respect to each other. It requires a separate driving means such as a rotatable cam for moving each separate unit, which means must be timed with the drive means for the aligning movement.

The developing device 4 according to FIG. 1 substantially improves on this prior apparatus by fixing the development units 10, 20, 30 and 40 with respect to each other in the carriage 50. As each developing unit becomes aligned with developing position 9, the applicator 11 is moved with respect to the rest of the unit toward drum 2 to seat rollers 60 on drum 2.

To accomplish this objective, applicator 11 is mounted on an applicator block 71 to form with applicator 11 and rollers 60, an applicator assembly. Applicator block 71 has an opening 72 in which applicator 11 is mounted. Opening 72 is larger than applicator 11 allowing developer from chamber 14 to move around sleeve 18 during development of an image. Applicator block 71 is loosely mounted in side walls 75 and 76 by mounting means 77 which allow limited movement of block 71 in a vertical direction. The side walls of block 71 fit loosely against side walls 75 and 76 allowing some lateral and tilting movement of block 71. A pair of lifters 80 are pivotably attached to opposite ends of the applicator block 71 and loosely attached to the ends of unit 10. Similar lifters are associated with units 20, 30 and 40.

Directly below each lifter 80 in carriage 50 is an engaging pin 83. Engaging pin 83 includes a sleeve 84, a pin core 85 mounted within sleeve 84 and a spring 86 within sleeve 84 urging pin core 85 in a downward direction. A pin and slot in pin core 85 and sleeve 84, respectively, prevent movement of pin core 85 out of sleeve 84. A pair of wedges 90 are pivotally secured to the base of the printer by pivots 91 and are aligned with the front and rear series of engaging pins, respectively.

As carriage 50 is moved from left to right as shown in FIG. 1, each of engaging pins 83 engages one wedge 90 as developing unit 10 becomes aligned with developing position 9. Engagement of pin 83 with wedge 90 forces core 85 in an upward direction against the force of spring 86. Spring 86 then urges the top of sleeve 84 against lifter 80 to urge lifter 80 in an upward direction against applicator block 71. Block 71 is moved upward until rollers 60 rest against drum 2 to position applicator 11 at the development position accurately spaced from drum 2. After development of a first electrostatic image, motor 52 is actuated again to drive carriage 50 further to the right. Gravity and two of rollers 60 urge block 71 and lifter 80 down to its original position. This movement can be assisted by a cantilever spring (not shown) urging block 71 downward against spring 86. Motor 52 drives carriage 50 to the right until applicator 21 of developing unit 20 becomes aligned with exposure position 9 and engaging pins 94 engage wedges 90 to move applicator 21 into appropriate position for toning a second electrostatic image. The process is repeated for developing units 30 and 40 with applicators 31 and 41 being moved into position in response to engagement of wedges 90 by engaging pins 95 and 96 respectively.

Note that if a slight amount of misalignment of unit 10 occurs, the loose mounting of block 7 between side walls 75 and 76 and the pivotal attachment of block 71 to lifter 80 allows some tilting and lateral movement of the block to accurately space applicators 11, 21, 31 and 41 as controlled by roller 60 on the surface of drum 2.

Figure 3:
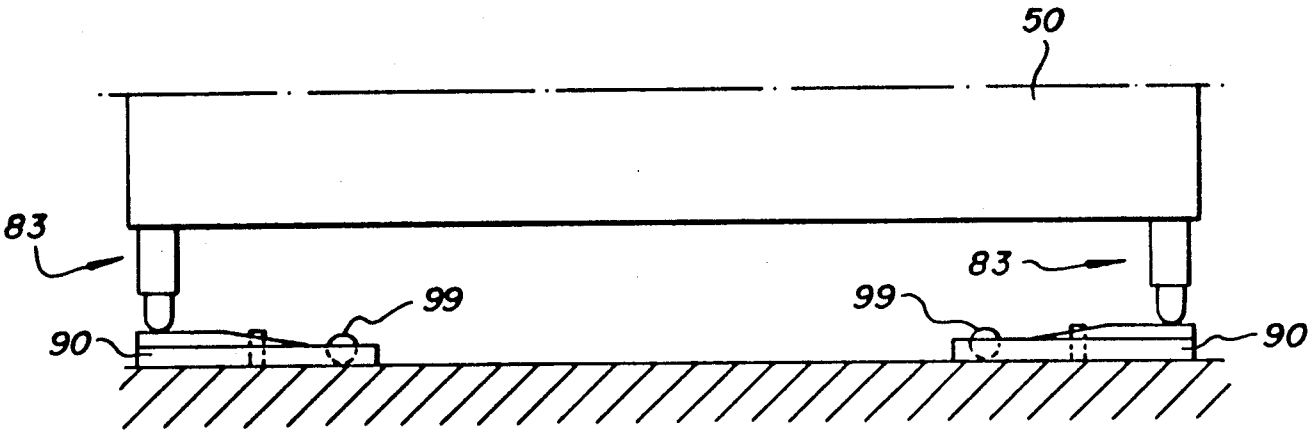
FIG. 3 is a right side view of a portion of the developing device shown in FIG. 2 with parts eliminated for clarity of illustration.

Motor 52 is reversed after all four images have been toned and the carriage 50 is returned to the left to its original position. During that return movement, to avoid interaction between the developing units and the drum, wedges 90 are pivoted out of the path of engaging pins 83, 94, 95 and 96 by solenoids 99 (see FIG. 3).

Alternatively, wedge 90 can be made symmetrical and a set of images toned on the return movement. This would require that every other set of images be exposed in an order reverse of the other sets of images. Alterations of this nature in the order of exposures in an electronic printer involves programming design well within the skill of the art.

Figure 2:
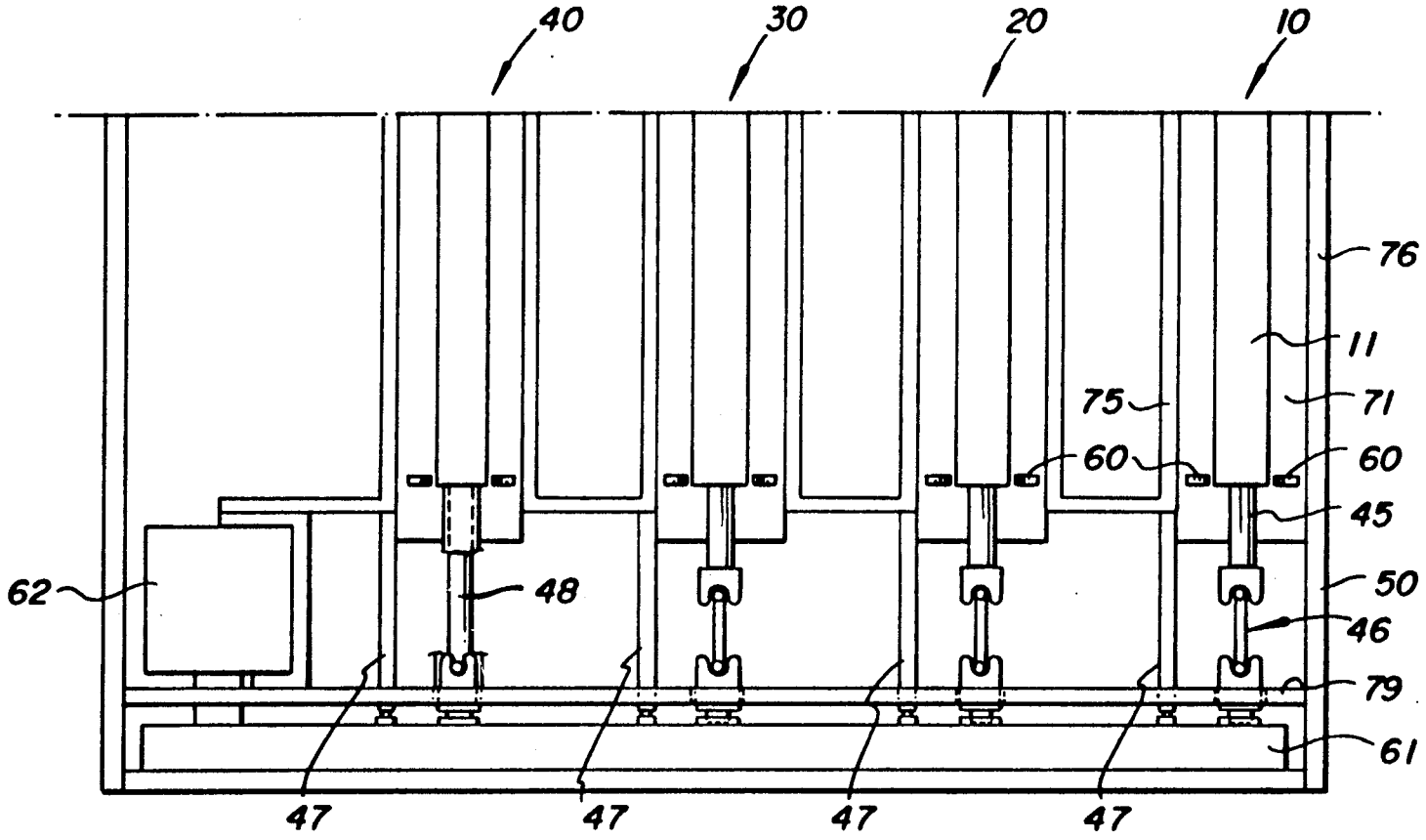
FIG. 2 is a top view, partially schematic, of a developing device of the printer shown in FIG. 1 with many parts eliminated for clarity of illustration and a few parts changed for variety of illustration.

FIG. 2 illustrates some of the advantages of moving only the applicator relative to the rest of the unit to finally position the applicator with respect to the drum at the development position 9. The applicator 11 has a rotatable magnetic core which must be driven during development. Typically it is driven at a speed of 1000 to 1300 revolutions per minute. Paddle 12 is driven at a much slower speed, for example, 50 to 300 revolutions per minute. Augers 13 are generally geared to paddle 12 within the unit itself. Development feed roller 16 is rotated a few rotations when toner is fed according to a program or demand from a toner monitor or pixel count of the printer. Development units such as these typically have three separate connections to one or more drive means to rotate these components; see, for example, U.S. Pat. No. 4,797,704 referred to above. An alternative to separate drives would be to gear the components together within each unit with a clutch actuable for occasional engagement of the toner feed roller. This latter approach would make each development unit unduly complex, especially with the substantial gear reductions required.

However, if the entire unit is moved with respect to the other units for final positioning of the applicator, each of the drive couplings for the moving station would have to absorb that movement. Moving only the applicator means that only one coupling for each unit need be of this complexity.

This is illustrated in FIG. 2. Applicator 11 includes a shaft 45 for driving rotatable magnetic core piece 17 (FIG. 1) which is connected by a universal coupling 46 through a loose fitting in a coupling wall 79 to a drive train 61. Note that seating of rollers 60 on drum 2 may cause some tilting or skewing of applicator block 71 with respect to side walls 75 and 76. Universal coupling 46 must absorb that possible movement as well as the more substantial vertical movement as the block is pushed up by engagement of the engaging pins 83 with the wedges 90 (FIG. 1). Because the units 10, 20, 30 and 40 are fixed with respect to each other (except for the applicator assemblies), the drive couplings to the paddles, for example, paddle 12, and the feed rollers, for example, feed roller 16, can be made as less expensive fixed couplings. For example, shafts 47 driving feed rollers 16 can extend from each development unit through walls 79 to drive train 61 without the need for a universal coupling or a loose fit with wall 79. Similarly, shafts 48 (shown in FIG. 2 only with respect to unit 40) are connected by a similarly fixed coupling to drive train 61. Drive train 61 is driven by a single motor 62 and includes clutches for each of shafts 47 to control toner feed according to program or demand.

As illustrated in FIG. 2, units 10, 20, 30 and 40 are made as a single integral component. It is removable as a unit from carriage 50. Walls between stations serve as a single wall for both stations. While this has many advantages in cost, weight, space and simplicity, it may be advantageous to have the black toner station 40 separately replaceable from the other three stations, since consumption of black toner is likely to be substantially different from consumption of the other three toners. Thus, one or all of the stations can be made separately removable. In such instance, a single wall would not be common for two stations and the carriage 50 would be provided with sufficient structure to nest each of the separately removable stations. This is best illustrated in FIG. 1 where units 10, 20 and 30 are a single removable integral unit containing cyan, magenta and yellow (for example) toners. Station 40 has its own separate walls and is separately removable and contains black toner.

Figure 15:
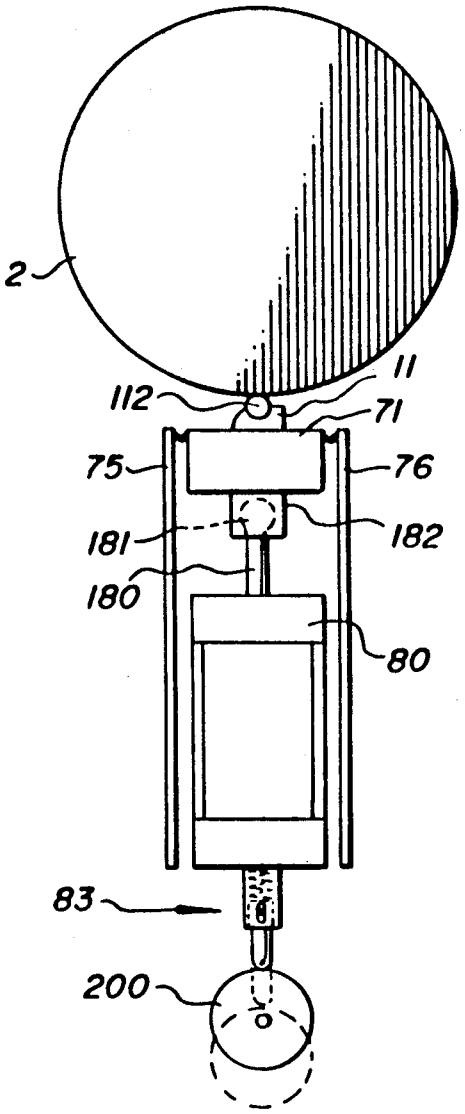
FIG. 15 is a front view illustrating a preferred lifter mechanism for the structure shown in FIG. 5.

Each applicator assembly, including an applicator block and an applicator is a small fraction of the weight of the entire developing unit including developer. Thus, spring 86 which provides the force for moving the applicator assembly into engagement with drum 2 can be of an appropriate modest strength. However, the utilization of wedges 90 in combination with engaging pins 83 to raise the applicator assembly is a scheme that could also be used to raise the entire unit if the units are constructed generally according to the prior art in which the entire unit has to be moved for final transverse positioning. In this instance, spring 86 must be of much greater magnitude. In each instance, wedges 90 provide an advantage of using the energy from motor 52 to provide the transverse movement of the unit, thus eliminating the separate drive conventionally used for that movement (and as shown in FIG. 15). Thus, the wedge 90 and engaging pin 83 concept can be used both in the structure shown in all the Figs. and also with the prior art structures. However, because of the lightness of the applicator assembly compared to the weight of the entire unit, this concept has particular application to the structure shown in the Figs.

Figure 4:
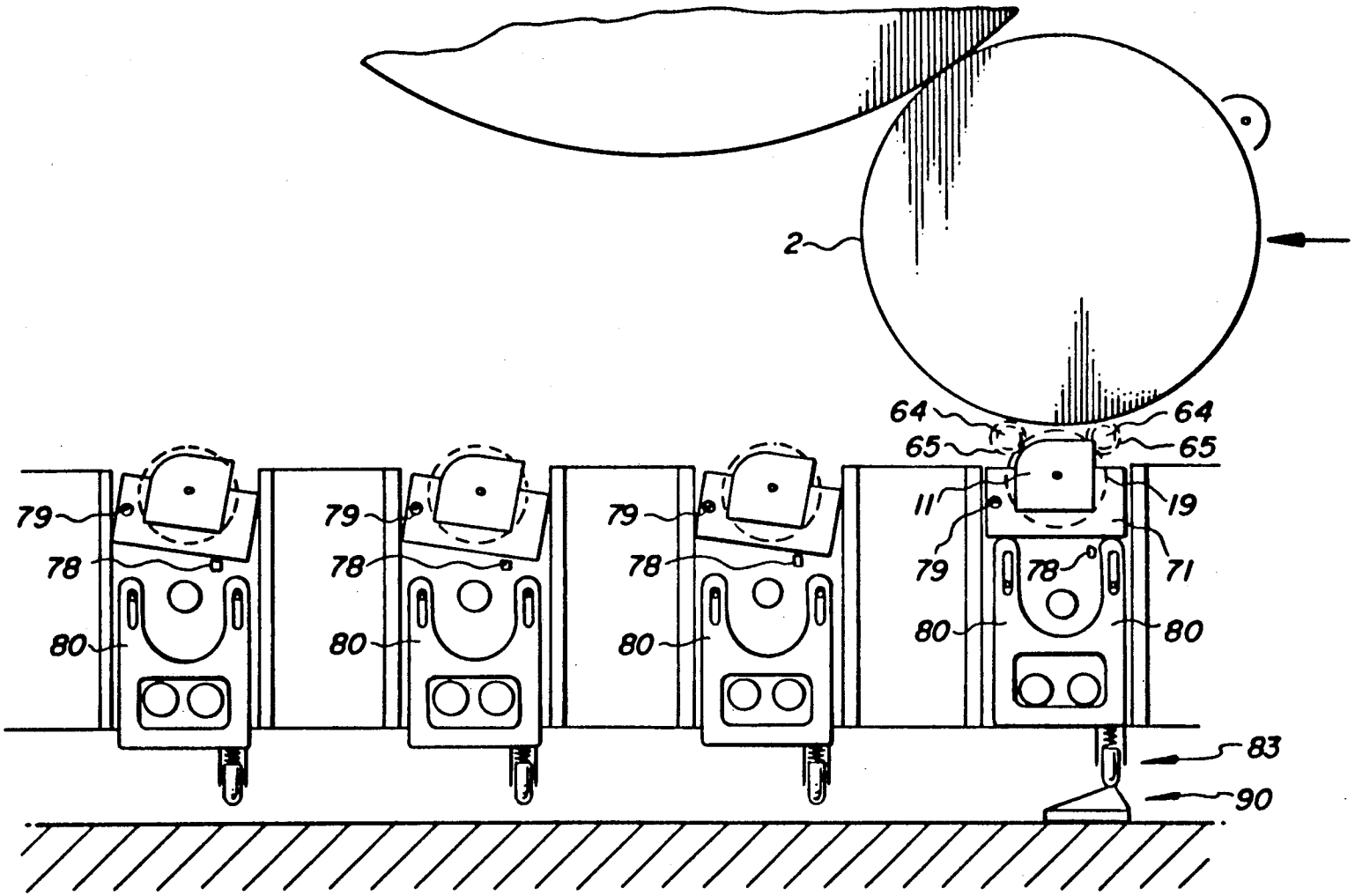
FIG. 4 is a front schematic similar to FIG. 1 showing an alternative construction of some portions.

FIG. 4 illustrates an alternative embodiment in which applicator blocks 71 are each pivotally mounted between a pivot 79 and a stopping lug 78. FIG. 4 also illustrates a different concept for positioning applicator 11 with respect to drum 2. Applicator 11 (and each of the other applicators) includes a disk 19 which can be mounted concentrically with the magnetic core shaft 45 (FIG. I) which seats on a pair of shafts 64 at each end of drum 2. Shafts 64 have rollers 65 mounted on them and are urged toward drum 62 by means not shown. Rollers 64 roll on drum 2 and provide a permanent means for engagement of disks 19 as applicator block 71 is pushed in its transverse direction. Pivot 79 should be a relatively loose pivot between a thin pin and a substantially larger hole which permits some adjustment for slight misalignments of the position of block 71 in response to contact of disks 19 and shafts 65. Shafts 64 and rollers 65 are not part of the development device 4, but can be part of the printer and/or drum structure.

Figure 6:
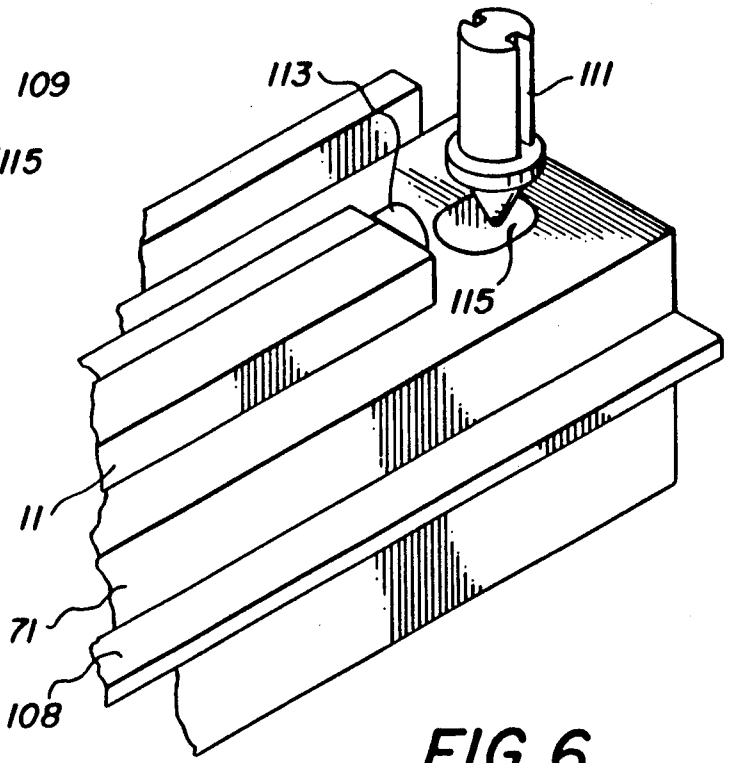
FIG. 6 is an enlarged view of a portion of the apparatus shown in FIG. 5.
Figure 5:
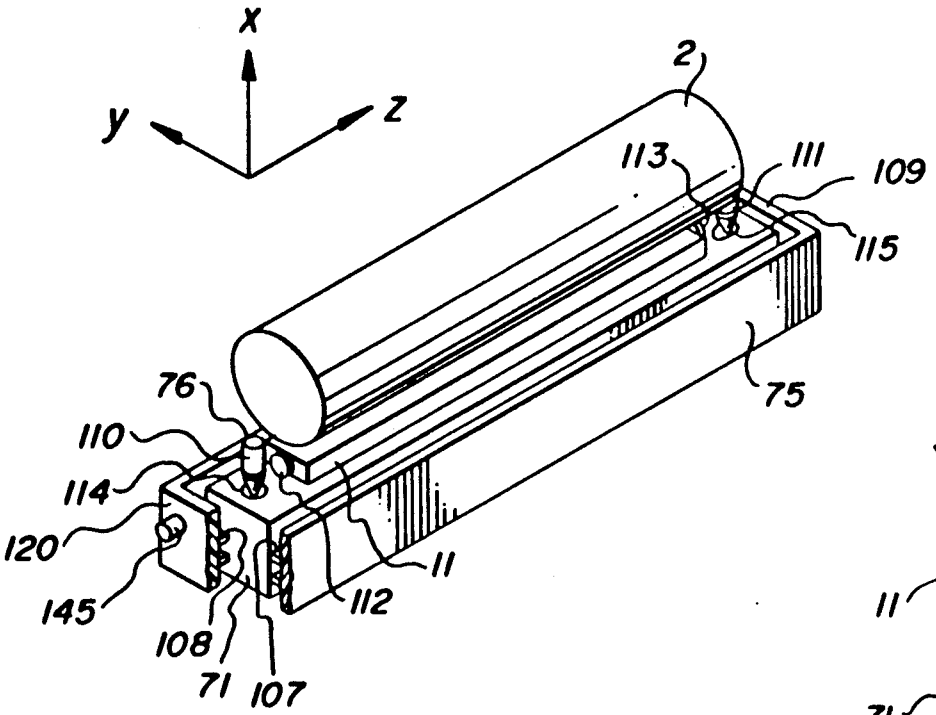
FIG. 5 is a perspective view of a portion of the apparatus shown in FIGS. 1 and 2 illustrating an alternative structure for positioning an applicator with respect to an image member.
Figure 7:
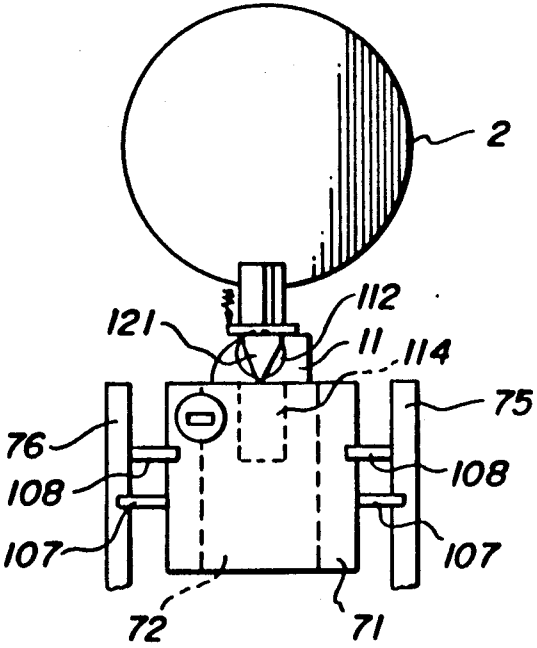
Figure 10:
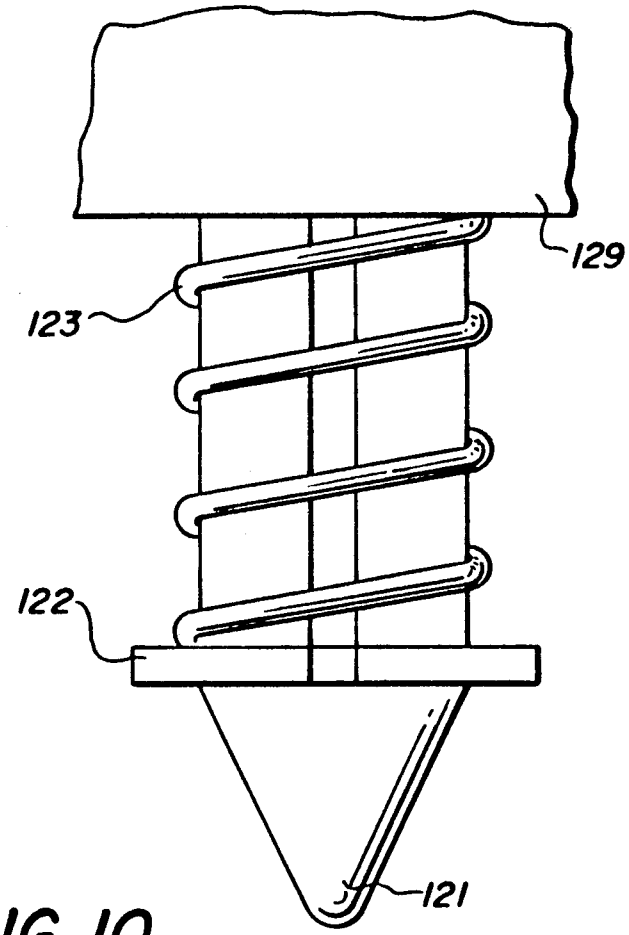
FIGS. 10 and 11 are left side views of positioning pin 110 together with a portion of its cooperating structure, including a cross-section of hole 114.
Figure 9:
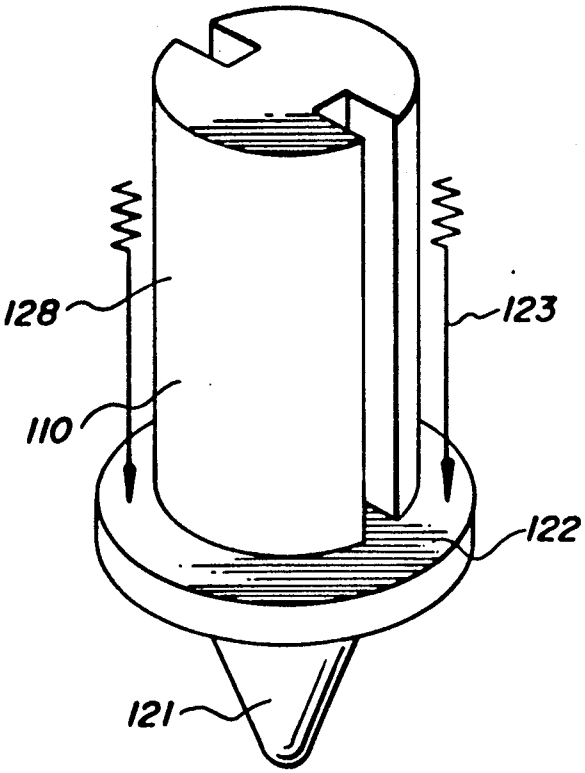
FIG. 9 is a perspective view of a positioning pin shown in FIGS. 5 and 6.

FIGS. 5-15 illustrate an alternative preferred embodiment for positioning applicator 11 with respect to drum 2. It also illustrates a preferred seating mechanism between block 71 and side walls 75 and 76 which can also be employed in the FIG. 1 embodiment. Referring to FIGS. 5-7, block 71 is movably positioned between walls 75, 76, 109 and 120. To prevent developing material from escaping around the block, a labyrinth seal is provided by felt members 107 and 108 which completely encircle block 71. Felt member 107 is attached to walls 75, 76, 109 and 120 and felt member 108 is attached to block 71 (as best illustrated with respect to walls 75 and 76 in FIG. 5). Felt members 107 and 108 prevent toner from escaping around block 71 and also fictionally hold block 71 between walls 75, 76, 109 and 120 while permitting a full range of movement as the applicator 11 is positioned in operative position with respect to drum 2.

As shown in FIG. 7, pads or seals 107 and 108 each have surfaces which slide on either wall 75, 76, 109 and 120 or on the side walls of block 71. Those surfaces that slide can be coated with a polytetrafluoroethylene or similar low surface adhesion material to permit easy movement of block 71 and less wear to pads 107 and 108.

Figure 13:
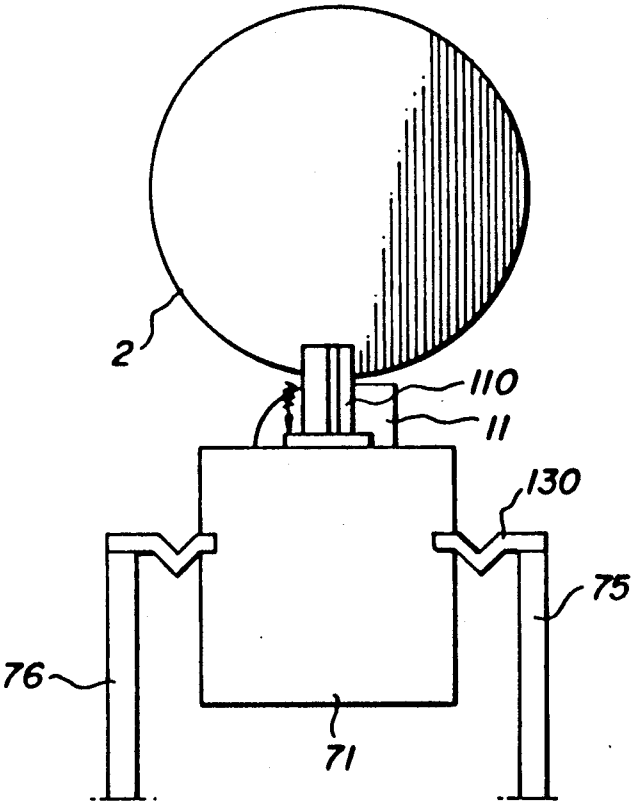
FIG. 13 is a front view similar to FIG. 7 illustrating an alternative sealing structure for applicator 71 to that shown in FIG. 7.

FIG. 13 illustrates another embodiment in which the foam pads 107 and 108 are replaced by a bellows 130 which, like the pads 107 and 108, extend completely around applicator block 71. Bellows 130 can be made of any suitable rubber, plastic or cardboard bellows material and secured by adhesives to both applicator block 71 and side walls 75, 76, 109 and 120.

Accurate positioning of applicator 11 with respect to drum 2 is accomplished in the embodiment shown in FIGS. 5-15 by a pair of pins 110 and 111 which are fixed with respect to drum 2 and a pair of rollers 112 and 113 which are fixed with respect to applicator 11 and a pair of holes 114 and 115 in block 71 which are also fixed with respect to applicator 11.

As applicator block 71 is moved upward by lifter 80 (FIG. 1) pins 110 and 111 enter holes 114 and 115, respectively. Pins 110 and 111 are shown in more detail in FIGS. 9-12. Each pin includes a conical point 121, a washer 122 which slides on a cylindrical portion 128 and a spring 123 which spring is mounted between washer 122 and a housing 129 for drum 2 to which the pin is fixed. The cylindrical portion 128 of each pin is slotted to prevent washer 122 from sliding off point 121. Pins 110 and 111 are mounted to be accurately aligned with each other and the axis of rotation of drum 2. In the preferred embodiment shown, they are vertically oriented, with the development position at the bottom of drum 2.

Figure 11:
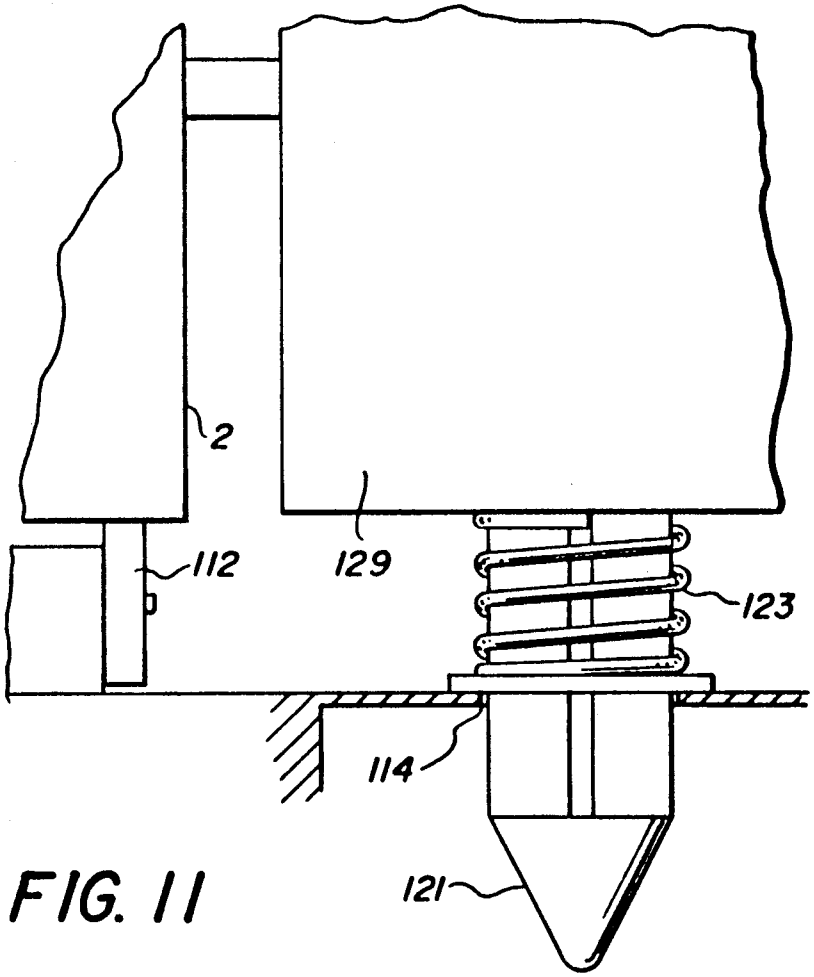

Hole 114 is circular in cross-section and sized to fit the cylindrical portion of pin 110. As seen in FIG. 11, the walls of hole 114 have a minimal depth and thus do not constrain the direction of pin 110 and therefore do not over-constrain the positioning system. Pin 110 thus can be skewed with respect to the top of block 71.

Figure 12:
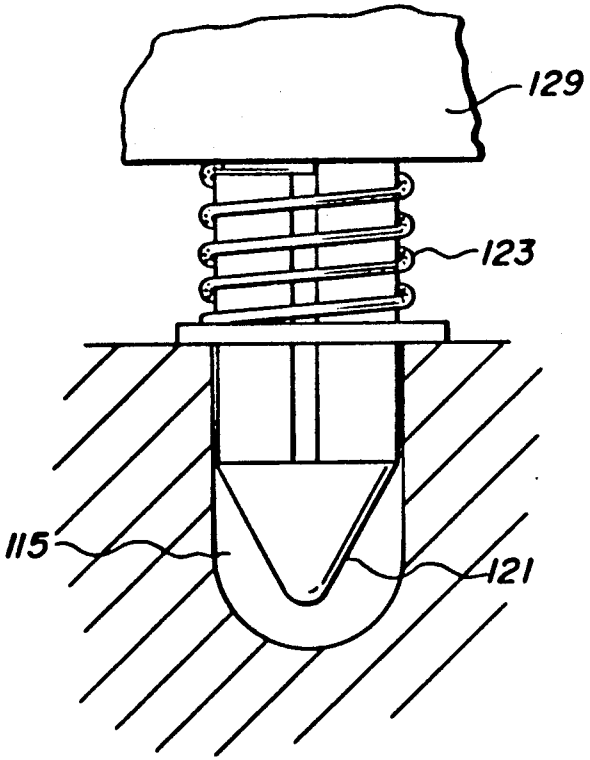
FIG. 12 is a rear view of pin 111 and a cross-section of hole 115.

Hole 115 is a slot with its long dimension running parallel to the axis of rotation of drum 2 and with a dimension across the slot that also fits the cylindrical portion of pin 111. As shown in FIG. 12, and unlike hole 114, hole 115 has side walls with sufficient depth to control the direction of pin 111 with respect to the walls. Holes 114 and 115 are centered on the axis of rotation of rotatable magnetic core 17 (FIG. 1). Thus, when the pins are seated in the holes the axes of rotation of the drum and core will be parallel.

Figure 8:
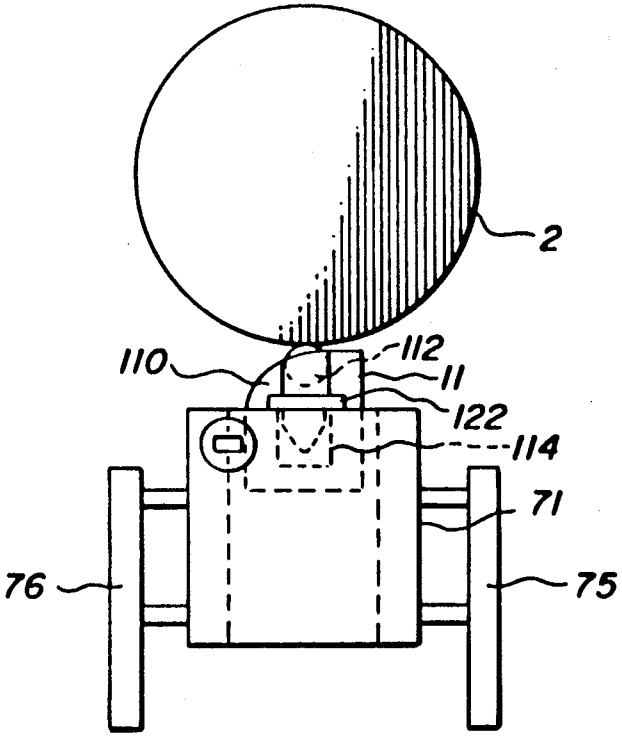
FIGS. 7 and 8 are front views of the portion shown in FIG. 5 with some parts eliminated for clarity of illustration.

Rollers 112 and 113 are mounted on the portion of the end faces of applicator 11 that extend above applicator block 71 and have an axis of rotation spaced directly above the axis of rotation of the rotatable magnetic core 17. Thus, as shown in FIG. 8, all of the key mounting elements are vertically aligned.

FIG. 5 includes reference axes x, y and z for describing the positioning of the applicator 11 with respect to drum 2. The z axis is parallel to the axis of rotation of drum 2. The x axis is orthogonal to the z axis in a plane including the axis of rotation of drum 2 and the development position. In the FIG. 5 embodiment it is vertical. The y axis is orthogonal to the x and z axes.

As lifters 80 push block 71 in an upward direction, pins 110 and 111 enter holes 114 and 115 until rollers 112 and 113 engage drum 2. At this point, pin 110 and hole 114 have established the linear position of applicator 11 in the y and z directions and with pin 111 and hole 115 have established its rotational position about the x axis. Engagement of rollers 112 and 113 with the drum have established the spacing between the applicator and the drum, that is, the linear position of the applicator 11 in the x direction as well as rotation about the y axis. Rotation about the z axis is established by pin 111 and the deep side walls of hole 115 (FIG. 12). The axes of rotation of the drum and core are parallel.

The spring 123 urging separation of washer 122 and a drum cartridge 129 is weaker than the springs 86 urging lifters 80 in an upward direction. When engaging pins 83 are no longer displaced upward and springs 86 are no longer urging lifters 80 in an upward direction, the force of springs 123 urging washers 122 in a downward direction assist gravity in pushing applicator block 71 also in a downward direction to move rollers 112 and 113 away from drum 2 and begin to remove pins 110 and 111 from holes 114 and 115 so that carriage 50 can move to bring the next unit to a position aligned with development position 9.

Pins 110 and 111 should be mounted on the same structure on which drum 2 is mounted. As shown in FIG. 11, if drum 2 is enclosed in a cartridge 129 allowing easy replacement of drum 2 when worn out, pins 110 and 111 should be secured in a wall of that cartridge and accurately positioned in manufacture of the cartridge 129 with respect to the axis of rotation of drum 2. This is illustrated schematically in FIG. 11. Notice that one of the dimensions most critical for operation of the development mechanism, the separation between the applicator 11 and the drum 2 is maintained by direct contact between rollers 112 and 113 and the drum periphery itself. The accuracy of this separation is dependent upon accuracy in the location of rollers 112 and 113 with respect to applicator 11. Rollers 112 and 113 can be applied to applicator 11 as part of its manufacturing process, thereby assuring this critical spacing. FIG. 8 illustrates the condition in which applicator 11 is operatively positioned with respect to drum 2 with its separation controlled by rollers 112 and 113 (only roller 112 being shown in FIG. 8).

The other positioning means, pins 110 and 111 and holes 114 and 115 are also important to the spacing between the applicator and the drum. For example, if the applicator is skewed around the x axis with respect to the drum (the drum and magnetic core axes are not parallel), the applicator will be closer to the drum in its middle compared to its ends. Rotation about the z axis also affects drum-applicator spacing because of the flat portion of the applicator facing the drum.

Figure 14:
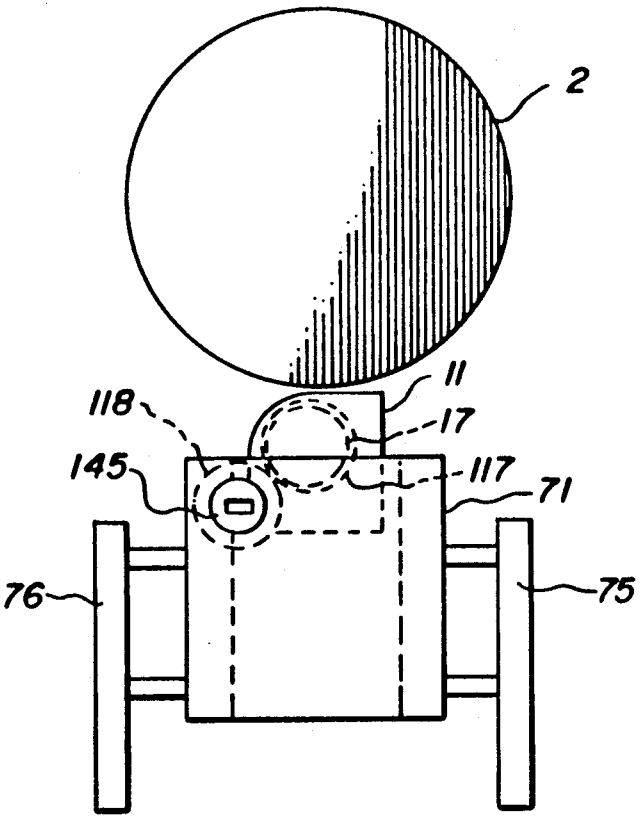
FIG. 14 is a front view similar to FIG. 7 illustrating gearing for the drive for the applicator shown in FIG. 5.

In the FIG. 1 embodiment, the shaft 45 for rotatable magnetic core 17 extends along the same axis through universal coupling 46 to gear box 61. As shown in FIGS. 5 and 8, such an extended shaft would encounter either pin 110 or pin 111. This problem can be handled in at least two ways. First, block 71 can be raised to a position substantially above shaft 45 with shaft 45 exiting through it and holes 114 and 115 being positioned above shaft 45. A second solution is shown in FIGS. 5 and 14. Referring to FIG. 14, rotatable magnetic core 17 is driven by a coaxial gear 117 fixed to its shaft. Gear 117 in turn is driven by a drive shaft 145 through a coaxial gear 118 fixed to it. This allows shaft 145 to be offset from pin 110 as shown in FIG. 5.

FIG. 15 illustrates a preferred lifter 80 particularly useable with highly accurate positioning mechanism such as that shown in FIGS. 5-11. For highest accuracy, block 71 must be free for some rotary and linear movement with respect to all three axes (see FIG. 5). According to FIG. 15, lifter 80 includes a rod 180 having a stationary ball 181 fixed to its end. Ball 181 fits in a spherical socket in socket member 182 to form a ball joint permitting universal angular movement of socket member 182. The top of socket member 182 is smooth and flat and slides on the bottom surface of block 71. Lifter 80 is moved in an upward direction in response to rotation of a separately driven cam 200 which engages engaging pin 83. Block 71 is free to adjust both rotationally and linearly with respect to all three axes as socket member 182 maintains its flat sliding contact with block 71. As shown in FIG. 15, block 71 seats accurately with respect to drum 2 using the positioning means shown in FIGS. 5 through 11. Pins 110 and 111 are eliminated from FIG. 15 for clarity of illustration, but roller 112 is shown in engagement with drum 2. Block 71 has adjusted slightly to the right and tilted slightly with respect to side walls 75 and 76 as permitted by ball 181 and socket member 182. Use of a separately driven cam 200 for moving lifters 80 upward is preferred for the FIGS. 5-15 embodiment, because any translational movement of pins 110 and 111 before withdrawal is prevented by holes 114 and 115.

The applicators shown in these embodiments include a rotatable magnetic core and stationary shell. Other known applicators, both magnetic and nonmagnetic, touching drum 2 in operation or spaced from it can be used. For example, a stationary magnetic core and rotating shell system or a single component nonmagnetic toning system, which typically involves applicator contact with drum 2 could be used. Precise location of the axis of rotation of such a contacting applicator with respect to the image member is important in such systems because that determines the pressure between the contacting surfaces and especially the evenness of such pressure.

In the FIGS. 1 and 2 embodiments, the supply of toner is shown as part of the development station. This requires replacement of the station when the supply of toner is exhausted or, alternatively, hand replacement of toner. An alternative approach is to have a separate supply of toner above an extended end of each unit which supply is replaceable without replacing the unit. This approach is conventional in copying apparatus. Obviously, the supply for the black unit 40 could be larger than the supply for the other three units.

The invention has been described in detail with particular reference to a preferred embodiment thereof, but it will be understood that variations and modifications can be effected within the spirit and scope of the invention as described hereinabove and as defined in the appended claims.

We claim:

1. Positioning apparatus for positioning an applicator of a development unit with respect to a surface of an image member at a developing position, said surface having a generally cylindrical shape at least at said development position, said cylindrical shape having an axis of rotation and opposite ends, and said positioning apparatus positioning said applicator and surface with respect to three orthogonal axes, a z axis parallel to the axis of rotation of the image member, an x axis parallel to a line between the development position and the axis of rotation, and a y axis orthogonal to the x and z axes, said apparatus including:

two spaced pins, each oriented generally parallel to the x axis and fixed with respect to one of said surface and said applicator, means defining two holes fixed with respect to the other of said surface and said applicator and positioned to receive said pins, one of said holes restricting relative movement of its pin parallel to both said y and z axes and the other hole restricting linear movement of its pin parallel only to said y axis, and means associated with one of said image member and applicator for engaging structure associated with the other of the image member and applicator for controlling the relative position of said surface and applicator parallel to the x axis.

2. Positioning apparatus according to claim 1 wherein one of said holes includes walls sufficiently deep to prevent rotation of its pin around the z axis and the other of said holes has walls not deep enough to restrict rotation of its pin about the z axis.

3. Apparatus according to claim 1 wherein said means for controlling the relative position of the image member and the applicator parallel to the x axis is a pair of rollers fixed to the applicator at each of opposing ends of said applicator and positioned and sized to engage said surface of the image member to control the relative position of said surface and the applicator with respect to the x axis.

4. Apparatus according to claim 1 wherein said image member is a photoconductive drum and said pins are fixed with respect to its surface.

5. Apparatus according to claim 4 wherein said drum and both pins are mounted in a removable cartridge.

6. Apparatus according to claim 5 wherein said pins each have a center line which intersects the axis of rotation of the drum.

7. Apparatus according to claim 1 wherein said applicator is part of a development unit, which unit is one of a plurality of units mounted for sequential positioning at said development position, each unit having an applicator with positioning means complimentary to the position means of the drum.

8. A cartridge for insertion in an image forming apparatus, said cartridge including:

a photoconductive drum, and pair of pins at opposite ends of said drum and fixed with respect to said drum for mating with positioning holes fixed with respect to a development applicator which applicator is part of the image forming apparatus.

9. A cartridge according to claim 8 wherein said pins have a centerline running through the axis of rotation of the drum.

10. A cartridge according to claim 8 wherein each of said pins includes a spring urged washer for urging an applicator away from said drum.

11. An image forming apparatus comprising:

a cartridge having a photoconductive drum, a developing unit having an applicator, positioning means associated with said drum and applicator for controlling their relative positions, said positioning means including:

a pair of pins fixed with respect to said drum, means defining a pair of holes fixed with respect to said applicator for receiving said pins, and means associated with said applicator for engaging said drum to provide a separation between said applicator and drum.

12. An image forming apparatus according to claim 11 wherein said apparatus has a plurality of development units, each movable to a single development position with respect to said drum and each having means defining a pair of holes for receiving said pins and means for engaging said drum to provide a separation between said applicator and drum.

13. Positioning apparatus for positioning a movable applicator of a movable development unit with respect to a surface of an image member at a developing position, said image member being a cylindrical photoconductive drum in a cartridge and, said surface having an axis of rotation, and said positioning apparatus positioning said applicator and surface with respect to three orthogonal axes, a z axis parallel to the axis of rotation of the image member, an x axis parallel to a line between the development position and the axis of rotation, and a y axis orthogonal to the x and z axes, said apparatus including:

positioning means fixed with respect to said surface, positioning means fixed with respect to and movable with said applicator for engaging said means fixed with respect to said surface to position said applicator parallel to said z axis, and means fixed with respect to said applicator for engaging said surface to control the relative positions of said surface and applicator rotationally with respect to the y axis and linearly with respect to the x axis.

14. The positioning apparatus according to claim 13 wherein said applicator is one of a plurality of applicators each part of a distinct development unit and each applicator is movable into said development position.

15. The positioning apparatus according to claim 14 wherein each applicator is also movable with respect to its development unit into said development position.

16. The positioning apparatus according to claim 14 wherein each of said development units contains toner of a color different from that of the other units.

17. The positioning apparatus according to claim 15 wherein each of said development units contains toner of a color different from that of the other units.

* * * * *